US007817938B2

(12) United States Patent
Igarashi

(10) Patent No.: US 7,817,938 B2
(45) Date of Patent: Oct. 19, 2010

(54) DEVELOPER CARTRIDGE AND IMAGE FORMING APPARATUS WITH SHAFT MISALIGNMENT ACCOMODATION

(75) Inventor: Hiroshi Igarashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 853 days.

(21) Appl. No.: 11/603,000

(22) Filed: Nov. 22, 2006

(65) Prior Publication Data

US 2007/0122188 A1 May 31, 2007

(30) Foreign Application Priority Data

Nov. 25, 2005 (JP) ..... 2005-340632

(51) Int. Cl.
*G03G 15/04* (2006.01)

(52) U.S. Cl. ..... 399/119; 399/222

(58) Field of Classification Search ..... 399/111, 399/113, 119, 222, 252, 265, 279
See application file for complete search history.

(56) References Cited

U.S. PATENT DOCUMENTS

| | | | | |
|---|---|---|---|---|
| 5,298,948 | A * | 3/1994 | Kurisu | 399/119 |
| 5,369,474 | A | 11/1994 | Yamada | |
| 5,583,630 | A * | 12/1996 | Kimura et al. | 399/227 |
| 5,768,656 | A * | 6/1998 | Nagasue et al. | 399/75 |
| 6,285,847 | B1 * | 9/2001 | Tanizaki et al. | 399/167 |
| 6,823,160 | B2 | 11/2004 | Okabe | |
| 7,035,569 | B2 * | 4/2006 | Park | 399/116 |
| 7,212,773 | B2 * | 5/2007 | Sudo et al | 399/222 |
| 7,292,808 | B2 * | 11/2007 | Murofushi | 399/167 |
| 7,395,014 | B2 * | 7/2008 | Kim et al. | 399/228 |
| 2002/0044305 | A1 | 4/2002 | Kawai et al. | |
| 2005/0063735 | A1 | 3/2005 | Okabe | |
| 2005/0169670 | A1 | 8/2005 | Noh | |
| 2005/0244191 | A1 | 11/2005 | Jang et al. | |

FOREIGN PATENT DOCUMENTS

| | | |
|---|---|---|
| CN | 1652039 | 8/2005 |
| EP | 1178370 A2 | 6/2002 |
| JP | 60-249729 A | 10/1985 |
| JP | 4-155356 A | 5/1992 |
| JP | 04-204970 | 7/1992 |

(Continued)

OTHER PUBLICATIONS

Extended European Search Report dated Apr. 16, 2007 in Application No. 06024315.1.

(Continued)

*Primary Examiner*—Robert Beatty
(74) *Attorney, Agent, or Firm*—Banner & Witcoff, Ltd.

(57) ABSTRACT

A developer cartridge includes a developer roller, a receiving unit for receiving a driving force, a transmitting unit for transmitting the driving force from the receiving unit to the developer roller, and a transferring unit for transferring the drive force from the receiving unit to the transmitting unit. The transferring unit is connected with both the receiving unit and the transmitting unit. A relative position of the receiving unit and the transmitting unit is movable while the transferring unit is connected to both the receiving unit and the transmitting unit.

14 Claims, 5 Drawing Sheets

FOREIGN PATENT DOCUMENTS

| | | | | |
|---|---|---|---|---|
| JP | 04-268576 | | | 9/1992 |
| JP | 08-006456 | | | 1/1996 |
| JP | 0943967 | | | 2/1997 |
| JP | 09-096937 | | | 4/1997 |
| JP | 09-230654 | | | 9/1997 |
| JP | 09311552 | A | * | 12/1997 |
| JP | 2000227690 | A | * | 8/2000 |
| JP | 2000227719 | | | 8/2000 |
| JP | 2002328499 | A | * | 11/2002 |
| JP | 2002328528 | | | 11/2002 |
| JP | 2003295614 | | | 10/2003 |
| JP | 2004-198634 | A | | 7/2004 |
| JP | 2004302352 | | | 10/2004 |

OTHER PUBLICATIONS

Notification of Reasons for Refusal for Japanese Application No. 2005-34032 Mailed Apr. 9, 2009.

Office Action mailed Aug. 15, 2008 received in corresponding Chinese Application No. 2006101639677 with translation.

* cited by examiner

DEVELOPER CARTRIDGE AND IMAGE FORMING APPARATUS WITH SHAFT MISALIGNMENT ACCOMODATION

CROSS-REFERENCE TO RELATED APPLICATION

This application claims priority benefits on the basis of Japanese Patent Application No. 2005-340632 filed on Nov. 25, 2005, the disclosure of which is incorporated herein by reference.

BACKGROUND OF THE INVENTION

1. Field of the Invention

The present invention relates to an image forming apparatus such as a laser printer and a developer cartridge to be removably provided in the image forming apparatus.

2. Description of the Related Art

In an image forming apparatus such as a laser printer, the developer cartridge that is removably mounted in an apparatus body has a toner accommodation chamber that accommodates a toner, a developer roller which carries the toner, a supply roller for supplying the toner accommodated in the toner accommodation chamber to the developing roller, an agitator for agitating the toner accommodated in the toner accommodation chamber, and the like.

In such developer cartridge, a gear mechanism section for rotationally driving an agitator, a developer roller and a supply roller is provided (e.g. c.f. Japanese Unexamined Patent Publication No. 2003-295614).

The gear mechanism section comprises an input gear for receiving a driving force transmitted from the apparatus body, a developer roller driving gear for rotationally driving the developer roller, a supply roller driving gear for driving the supply roller, and an agitator driving gear for driving the agitator. The gear mechanism section receives the driving force transmitted from the apparatus body at the input gear, and then the input gear transmits the force to the developer roller driving gear, the supply roller driving gear and the agitator driving gear.

In the apparatus body, a motor and a coupling member to which the driving force from the motor is transmitted are provided. The coupling member is retreatably connected with the input gear in synchronization to a cover member, which is opened/closed when a developer cartridge is attached/detached.

That is to say, when the cover member is opened, the coupling member retreats relative to the input gear, and when a cover member is closed, the coupling member advances relative to the input gear. Therefore, when a cover member is opened and a developer cartridge is mounted to the apparatus body, and then the cover member is closed, the coupling member advances relative to the input gear, whereby connecting the coupling member and the input gear.

SUMMARY OF THE INVENTION

An aspect of the present invention is to provide a developer cartridge comprising a developer roller, a receiving unit for receiving a driving force, a transmitting unit for transmitting the driving force from the receiving unit to the developer roller, and a transferring unit for transferring the drive force from the receiving unit to the transmitting unit, the transferring unit being connected with both the receiving unit and the transmitting unit, wherein a relative position of the receiving unit and the transmitting unit is movable while the transferring unit is connected to both the receiving unit and the transmitting unit.

Another aspect of the present invention is to provide an image forming apparatus comprising a body, a driving unit provided in the body, and a developer cartridge removably attachable to the body, wherein the developer cartridge comprises a developer roller, a receiving unit for receiving a driving force from the driving unit, a transmitting unit for transmitting the driving force from the receiving unit to the developer roller, and a transferring unit for transferring the drive force from the receiving unit to the transmitting unit, and wherein a relative position of the receiving unit and the transmitting unit is movable while the transferring unit transfers the drive force from the receiving unit to the transmitting unit.

Still another aspect of the present invention is to provide a developer cartridge removably attachable to an image forming apparatus comprising a developer roller, and a first gear configured to be connected to a second gear provided in the image forming apparatus, the first gear being configured to rotate the developer roller, the first gear including first gear teeth on a peripheral surface of the first gear, wherein the first gear teeth are configured to engage with second gear teeth provided on a peripheral surface of the second gear when the developer cartridge is attached to the image forming apparatus.

5(*a*) shows the developer cartridge in a non-pressed position, and

5(*b*) shows the developer cartridge in a pressed position.

Figure 6:
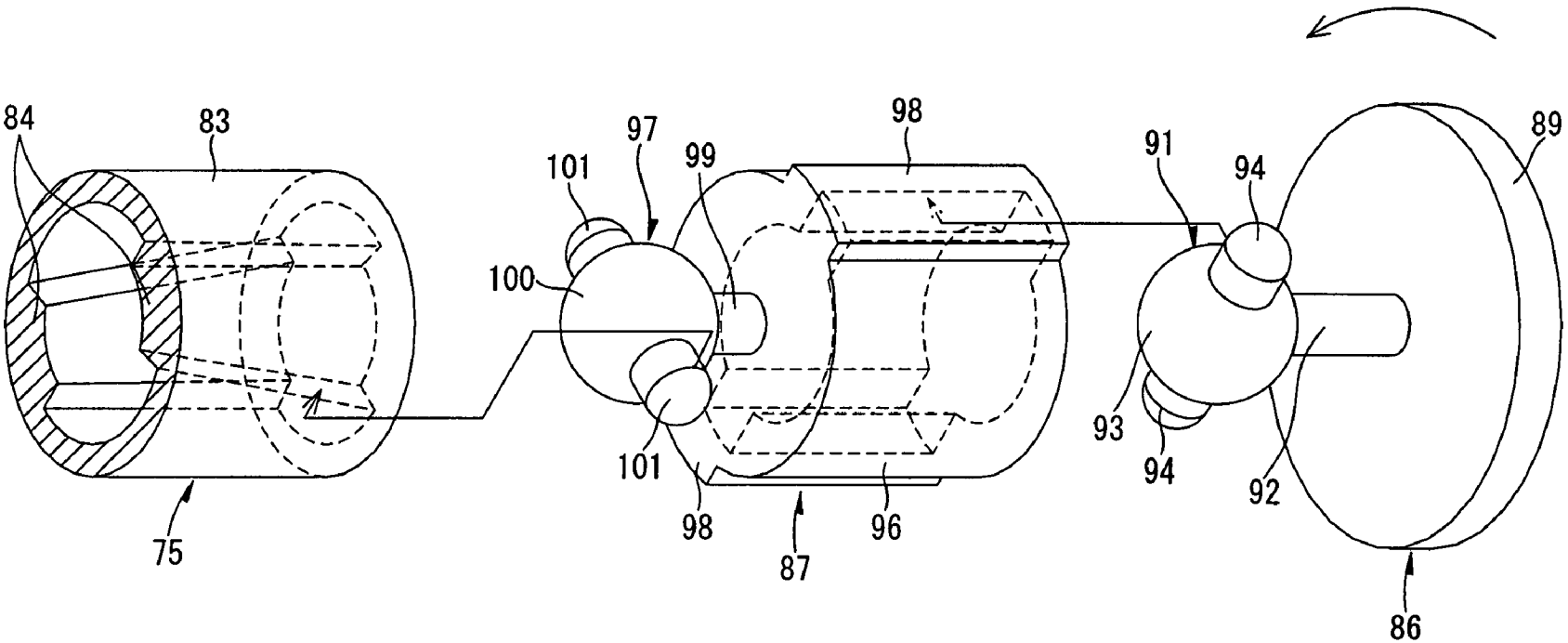

FIG. 6 is a perspective view showing a shaft coupling.

DETAILED DESCRIPTION OF PREFERRED EMBODIMENTS

1. An Overall Construction of a Laser Printer

Figure 1:
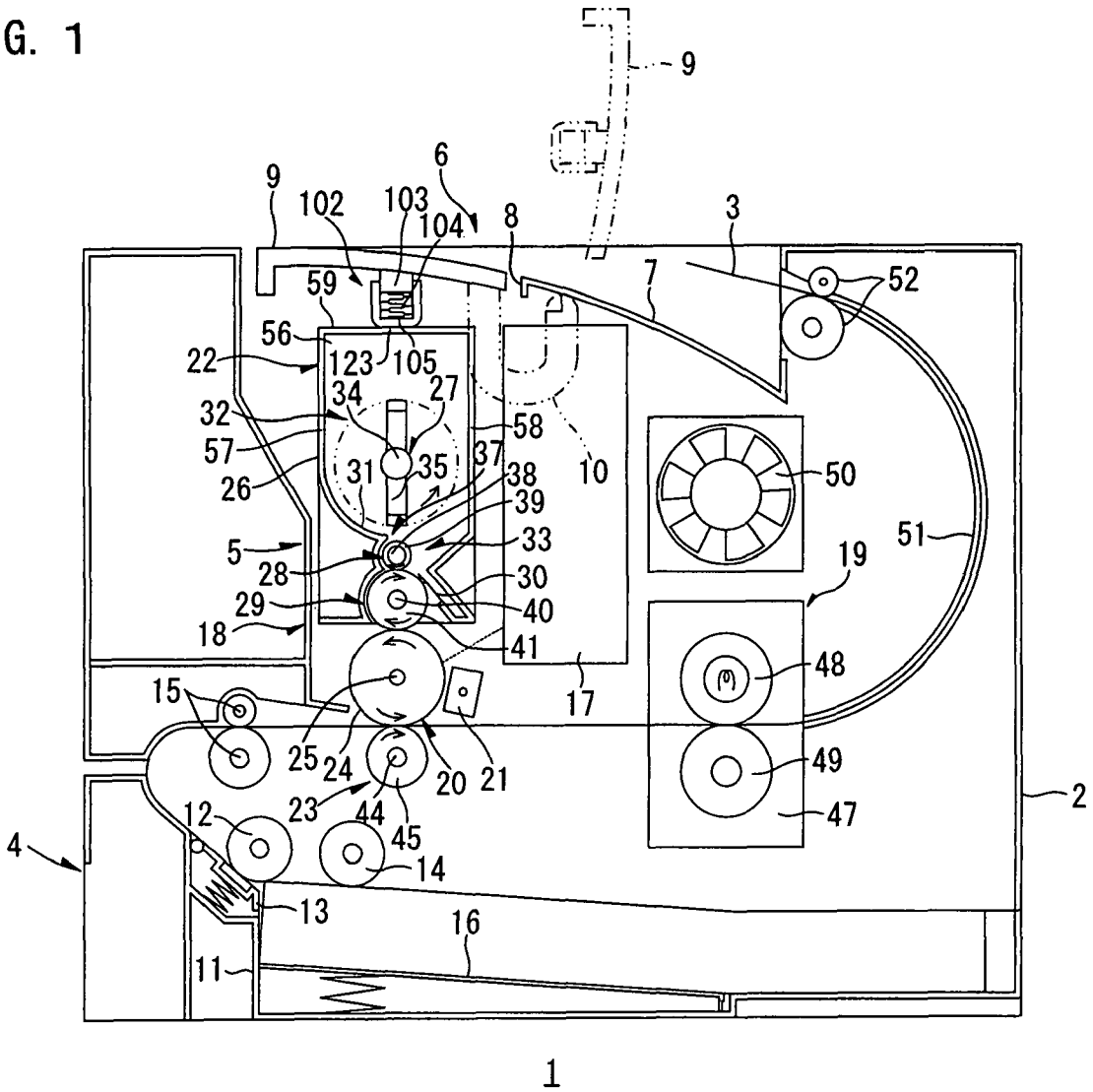
FIG. 1 is a side sectional view showing a main portion of a laser printer according to the present invention.

FIG. 1 is a side sectional view showing a main portion of a laser printer according to the present invention.

As shown in FIG. 1, this laser printer 1 comprises a main body casing 2, a feeder section 4 provided in the main body casing 2 for feeding a sheet 3, an image forming section 5 for forming an image on the fed sheet 3, and a sheet ejecting section 6 for ejecting the sheet 3 to which the image is formed.

In the following description of a developer cartridge 22 and the laser printer 1, FIG. 1 is the basis, defining the left side of the sheet surface as the "front side", the right side of the sheet surface as the "rear side", the back side of the sheet surface as the "left side", and the front side of the sheet surface as the "right side".

(1) Main Body Casing

A sheet ejection tray 7 of the sheet ejecting section 6 and an upper opening 8 for attaching/detaching the developer cartridge 22 are formed in the main body casing 2, and an openable top cover 9 is provided to the upper opening 8.

The sheet ejection tray 7 is formed in a rectangular shape in plan view so that a sheet 3 can be placed on the tray. The sheet ejection tray 7 is successionally and unitarily formed on the top wall of the main body casing 2, and formed to curve and sink downward from the front side to the rear side.

The upper opening 8 is formed in a rectangular shape in plan view, as a result of opening a generally half portion of the front side of the sheet ejection tray 7.

The top cover 9 is formed in a rectangular shape in plan view, serving as the generally half portion of the front side of the sheet ejection tray 7, and provided on the upper opening 8 so that the upper opening 8 is opened or closed. One end portion of an arm member 10 that is generally in U shape in side view is fixed to the lower surface of the rear end portion of the top cover 9. The other end portion of the arm member 10 is pivotably supported on the lower surface of the front end portion of the generally half portion of the rear side of the sheet ejection tray 7.

Thereby, when a developer cartridge 22 is attached/detached, the top cover 9 opens the upper opening 8 due to the upward pivot of the arm member 10, and when the apparatus is in an image forming operation, the top cover 9 closes the upper opening 8 due to the downward pivot of the arm member 10.

(2) Feeder Section

The feeder section 4 comprises a sheet feeding tray 11 that is mounted removably in the front and rear direction at the bottom portion inside the main body casing 2, a separation roller 12 and a separation pad 13 which are provided at the upper front end portion of the sheet feeding tray 11, a sheet feeding roller 14 provided at the rear side of the separation roller 12 (the upstream side of the feeding direction of the sheet 3, relative to the separation pad 13). Furthermore, the feeder section 4 comprises a registration roller 15 having a pair of rollers provided above the separation roller 12 (the downstream side of the feeding direction of the sheet 3, relative to the separation roller 12).

A sheet feeding path of the sheet 3 from the separation roller 12 to the registration roller 15 is formed generally in U shape from the separation roller 12 towards the registration roller 15 as to fold backward to the rear.

A sheet pressing plate 16 on which sheets 3 are placed in a stacked manner is provided inside the sheet feeding tray 11. The front end portion of the sheet pressing plate 16 is raised and lowered in the up and down direction by being swingably supported at the rear end portion.

The uppermost sheet 3 of the sheet pressing plate 16 is pressed against the sheet feeding roller 14, fed between the separation roller 12 and the separation pad 13 by the rotation of the sheet feeding roller 14, then sandwiched between the separation roller 12 and the separation pad 13 to be separated from other sheets 3 and be fed one by one by the rotation of the separation roller 12.

The fed sheet 3 is fed backward along a sheet feeding path formed in U shape, transported by the registration roller 15 to a transferring position for transferring a toner image to the sheet 3 after registration. The transferring position is later described, at which a toner image on a photosensitive drum 20 is transferred and which is disposed between the photosensitive drum 20 and a transfer roller 23.

(3) Image Forming Section

The image forming section 5 comprises a scanner section 17, a processing section 18 and a fixing section 19.

(a) Scanner Section

The scanner section 17 is provided in the center portion in the front and rear direction of the main body casing 2 and although not shown, comprises a laser light source, a rotationally driven polygon mirror, an fθ lens, a reflector, and the like.

A laser beam that is emitted from a laser light source based on an image data is deflected by the polygon mirror, and after the beam passes through an fθ lens, the light path of the beam is turned back by a reflector. After the beam passes the lens, the beam is irradiated to the surface of the photosensitive drum 20 of the processing section 18.

(b) Processing Section

The processing section 18 is provided in the front of the scanner section 17 inside the main body casing 2. The processing section 18 comprises the photosensitive drum 20, a scorotron type charger 21, the developer cartridge 22 and the transfer roller 23.

Figure 3:
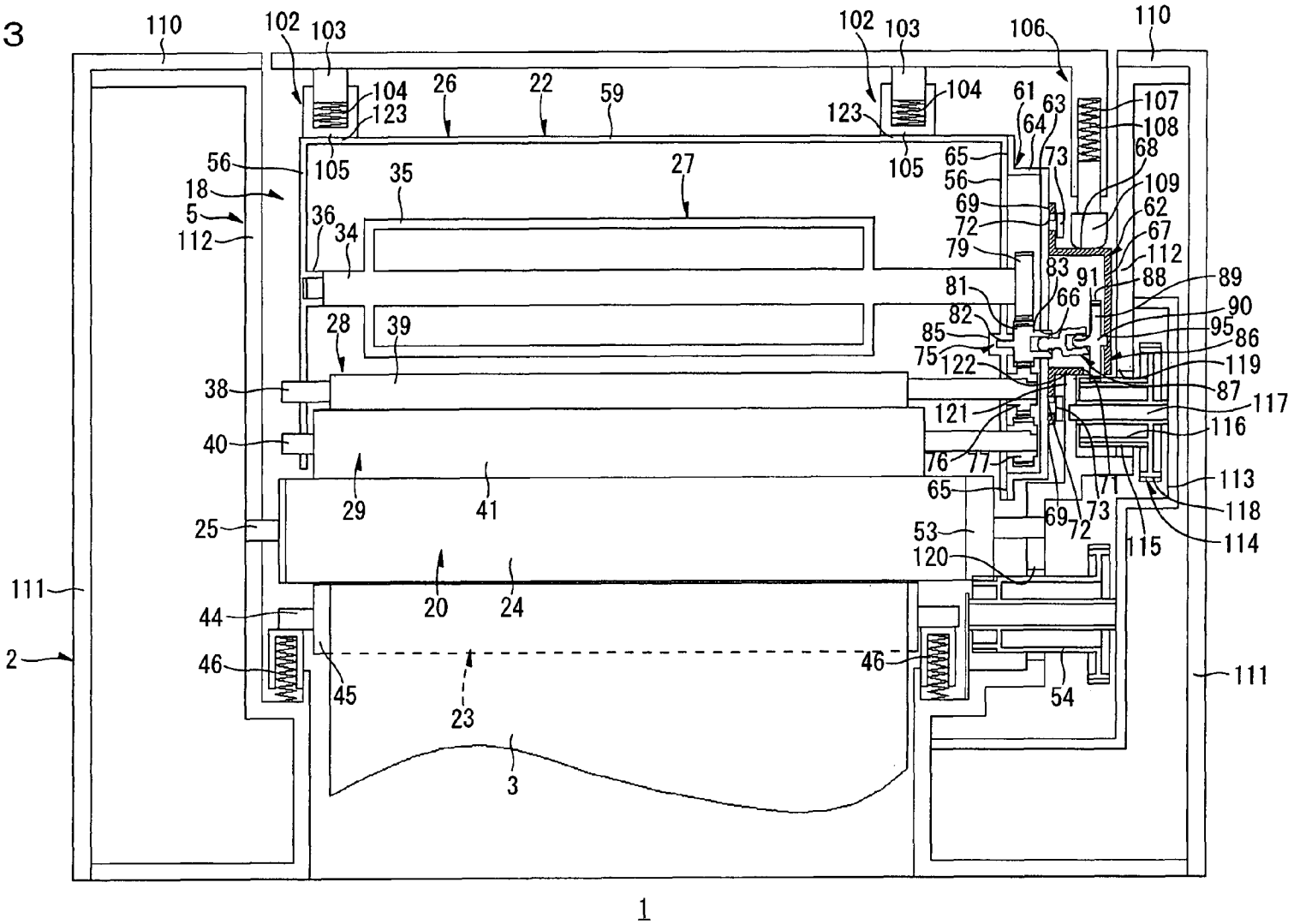
FIG. 3 is a front sectional view of the laser printer (with the developer cartridge attached).

The photosensitive drum 20 is cylindrically formed, and comprises a drum body 24 whose outermost surface layer is formed of a photosensitive layer of such as polycarbonate with a positive charge, and a metal drum shaft 25 that extends along the lengthwise direction of the drum body 24 at the shaft center of the drum body 24. The drum shaft 25 is supported on a support sidewall 112 (later described) of the main body casing 2, and the drum body 24 is rotatably supported relative to the drum shaft 25, as shown in FIG. 3.

A drum gear 54 that is rotatably supported on the gear support wall 113 (later described) of the main body casing 2 is provided on the lower side of one end portion in the axial direction of the drum body 24 (right end portion). The drum gear 54 is inserted through a drum gear opening 120 which is perforated in the support sidewall 112. An outer peripheral tooth 53 is provided on one end portion in the axial direction of the drum body 24, and the outer peripheral tooth 53 and the drum gear 54 are meshed.

In an image forming operation, a driving force from a motor (not shown) provided in the main body casing 2 is input to the drum gear 54, the drum gear 54 is rotationally driven, the outer peripheral tooth 53 that meshes with the drum gear 54 is rotationally driven, and thus the drum body 24 is rotationally driven about the drum shaft 25.

The scorotron type charger 21, as shown in FIG. 1, is supported on the main body casing 2 at the rear side of the photosensitive drum 20, and is disposed in an opposed relation to the photosensitive drum 20 at an interval so as not to come into contact with the photosensitive drum 20.

The scorotron type charger 21 comprises a discharge wire and a grid. In an image forming operation, a bias voltage is applied to the grid while a high voltage is applied to the discharge wire to conduct a corona discharge of the discharge wire, whereby the surface of the photosensitive drum is charged uniformly in positive polarity.

The developer cartridge 22 is removably mounted in the main body casing 2, and comprises a housing 26, and an agitator 27, a supply roller 28, a developer roller 29 and a layer-thickness regulation blade 30 which are provided in the housing 26.

The housing 26 is formed in a box-shape with the lower side open, and unitarily comprises two sidewalls 56 (c.f. FIG. 3) that are disposed in an opposed relation to each other at an interval in widthwise direction (left and right direction), a front wall 57 that covers the space between the front ends of the two sidewalls 56, a rear wall 58 that covers the space between the rear ends of the two sidewalls 56, and a top wall 59 that covers the space between the upper ends of the two sidewalls 56.

Both end portions in the widthwise direction of the upper surface of the top wall 59 serves as pressed portions 123 that are pressed by a housing pressing members 102 described later (cf. FIG. 3).

Furthermore, a partition plate 31 that partitions the interior of the housing 26 into an upper space and a lower space is provided in the housing 26 at midway in up and down direction. The upper space of the housing 26 partitioned by the partition plate 31 serves as a toner accommodation chamber 32 in which a toner is accommodated and the agitator 27 is provided. Furthermore, the lower space of the housing 26 partitioned by the partition plate 31 serves as a developing chamber 33 in which the supply roller 28, the developer roller 29, and the layer-thickness regulation blade 30 are provided.

In the toner accommodation 32, a non-magnetic single-component toner with a positive charge is accommodated as a developing agent. A polymerized toner obtained by copolymerizing a polymerizable monomer through suspension polymerization and the like is used as the toner. Examples of the polymerizable monomer include a styrene monomer such as styrene, and acrylic monomer such as acrylic acid, alkyl (C1-C4) acrylate, and alkyl (C1-C4) methacrylate. The polymerized toner is generally globular, has an extremely good fluidity, and can achieve a high-resolution image forming.

Coloring agent such as carbon black, wax or the like is combined to such toner, and in order to improve the fluidity, an external additive such as silica is added. An average grain diameter of a toner is about 6-10 μm.

The agitator 27 is disposed in the center of the toner accommodation chamber 32, and comprises an agitator rotating shaft 34 and an agitation blade 35.

The agitator rotating shaft 34 is rotatably supported on the two sidewalls 56 of the housing 26 (c.f. FIG. 3). More specifically, one shaft end portion (right side) of the agitator rotating shaft 34 is inserted through one of the sidewalls 56, thereby being rotatably supported on the sidewall 56, while the other shaft end portion (left side) of the agitator rotating shaft 34 is rotatably supported on a bearing 36 which is provided on the inner surface of the other sidewall 56, thereby being rotatably supported on the sidewall 56.

The agitation blade 35 is provided so as to extend in the radial direction from the agitator rotating shaft 34. The agitator 27 is rotated by input of the driving force from a motor (not shown) to the agitator rotating shaft 34 in the image forming operation, as described later. When the agitator 27 is rotated, a toner in the toner accommodation chamber 32 is agitated, and discharged towards the developing chamber 33 from an opening 37 which is disposed in the rear of the partition plate 31 and communicates in the up and down direction.

The supply roller 28 is disposed at the lower side of the opening 37 in the developing chamber 33. The supply roller 28 comprises a metal supply roller shaft 38 and a sponge roller 39 made of an electrically conductive foamed material that covers the supply roller shaft 38. The supply roller shaft 38 is inserted through the both sidewalls 56 of the housing 26, thereby being rotatably supported on the two sidewalls (c.f. FIG. 3). The supply roller 28 is rotationally driven by inputting the driving force from a motor to the supply roller shaft 38 in the image forming operation, described later.

The developer roller 29 is disposed at the lower side of the supply roller 28 so that the developer roller 29 and the supply roller 28 contacts and compresses to each other. The developer roller 29 comprises a metal developing roller shaft 40 and a rubber roller 41 made of an electrically conductive rubber material that covers the developing roller shaft 40. The developing roller shaft 40 is inserted through the both sidewalls 56 of the housing 26, thereby being rotatably supported on the both sidewalls (c.f. FIG. 3). The rubber roller 41 is formed of an electrically conductive urethane rubber or silicone rubber that includes carbon fine particles and the like, and a coat layer of a urethane rubber or a silicone rubber in which fluorine is contained is coated on the surface of the rubber roller 41. The developer roller 29 is rotationally driven by inputting the driving force from a motor to the developing roller shaft 40 in the image forming operation, as described later. Furthermore, a developing bias is applied to the developer roller 29 in the image forming operation.

The layer-thickness regulation blade 30 comprises a blade body including a metal leaf spring member, and a pressing portion of an insulative silicone rubber provided at the free end portion of the blade body and is semicircular in cross section. In the layer-thickness regulation blade 30, the pressing portion is pressed against the developer roller 29 from the rearward by an elastic force of the blade body, which is due to having the base end portion of the blade body be supported on the housing 26 at the rearward of the developer roller 29.

A toner discharged from the opening 37 is supplied to the developer roller 29 due to rotation of the supply roller 28, and at this time, is triboelectrified in positive polarity between the supply roller 28 and the developer roller 29. The toner supplied to the surface of the developer roller 29 enters between the pressing portion of the layer-thickness regulation blade 30 and the rubber roller 41 of the developer roller 29 with the rotation of the developer roller 29, and carried onto the surface of the developer roller 29 as a thin layer with a uniform thickness.

The transfer roller 23 is provided below the photosensitive drum 20, and disposed in opposed relation in the up and down direction so as to come in contact with the photosensitive drum 20. The transfer roller 23 comprises a metal transfer roller shaft 44 and a rubber roller 45 made of an electrically conductive rubber material that covers the transfer roller shaft 44.

In the transfer roller 23 as shown in FIG. 3, both end portions in the axial direction of the transfer roller shaft 44 are supported by the spring members 46 provided on the support sidewalls 112 of the main body casing 2 (later described) so as to be biased upward, below both end portion in the widthwise direction of the transfer roller 23. Thus, the transfer roller 23 is pressed against the photosensitive drum 20. Furthermore, a transfer bias is applied to the transfer roller 23 in the image forming operation. Furthermore, a transfer roller 23 is rotationally driven by inputting the driving force from a motor (not shown) to the transfer roller shaft 44 in the image forming operation.

As shown in FIG. 1, with the rotation of the photosensitive drum 20, the surface of the photosensitive drum 20 is uniformly charged in positive polarity by the scorotron type charger 21, then exposed to a high-speed scanning by a laser beam from the scanner section 17, and an electrostatic latent image corresponding to an image to be formed on the sheet 3 is formed.

Subsequently, due to the rotation of the developer roller 29, when a toner that is carried on the surface of the developer roller 29 and charged in positive polarity contacts in a opposed relation with the photosensitive drum 20, the toner is supplied to the electrostatic latent image formed on the surface of the photosensitive drum 20, that is, an exposed portion which is exposed by a laser beam and hence electric potential is low among the surface of the photosensitive drum 20 charged uniformly in positive polarity. Thereby, the electrostatic latent image of the photosensitive drum 20 becomes a visible image, and a toner image by a reversal developing is carried onto the surface of the photosensitive drum 20.

The toner image carried on the surface of the photosensitive drum 20 is then transferred to the sheet 3 by the transfer bias applied to the transfer roller 23 while the sheet 3 transported by the registration roller 15 passes through the transferring position between the photosensitive drum 20 and the transfer roller 23. The sheet 3 to which the toner image is transferred is transported to the fixing section 19.

(c) Fixing Section

The fixing section 19, as shown in FIG. 1, is provided on a rear side of the scanner section 17 and comprises a fixing frame 47, and a heating roller 48 and a pressing roller 49 that are provided in the fixing frame 47. Furthermore, the fixing section 19 comprises a fan 50 provided above the fixing frame 47.

The heating roller 48 comprises a metal tube in which the surface is coated with fluorine resin, and a halogen lamp for heating which is inserted in the metal tube. The heating roller 48 is rotationally driven by inputting the driving force from a motor.

The pressing roller 49 is disposed in opposed relation to the heating roller 48 below the heating roller 48 so as to press the heating roller 48. The pressing roller 49 comprises a metal roller shaft and a rubber roller of a rubber material that coats the roller shaft. The pressing roller 49 is driven in conformity to the rotational drive of the heating roller 48.

The fan 50 exhausts the heat generated during fixation above the fixing frame 47 to the exterior of the main body casing 2.

In the fixing section 19, the toner image transferred to the sheet 3 at the transferring position is thermally fixed while the sheet 3 passes through between the heating roller 48 and the pressing roller 49. The sheet 3 to which the toner image is fixed is transported towards the sheet ejecting section 6.

(d) Sheet Ejecting Section

The sheet ejecting section 6 comprises the above-mentioned sheet ejection tray 7, a sheet ejection path 51 that transports the sheet 3 from the fixing section 19 to the sheet ejection tray 7, and a sheet ejection roller 52 provided on the sheet ejection path 51. The sheet ejection path 51 is folded forward from the fixing section 19 towards the sheet ejection tray 7 in a generally U shape. The sheet ejection roller 52 is provided at an end portion of the downstream side in the transporting direction of the sheet ejection path 51.

The sheet 3 that is thermally fixed in the fixing section 19 is transported to the sheet ejection roller 52, then ejected onto the sheet ejection tray 7 by the sheet ejection roller 52.

2. Construction of Developer Cartridge

Figure 2:
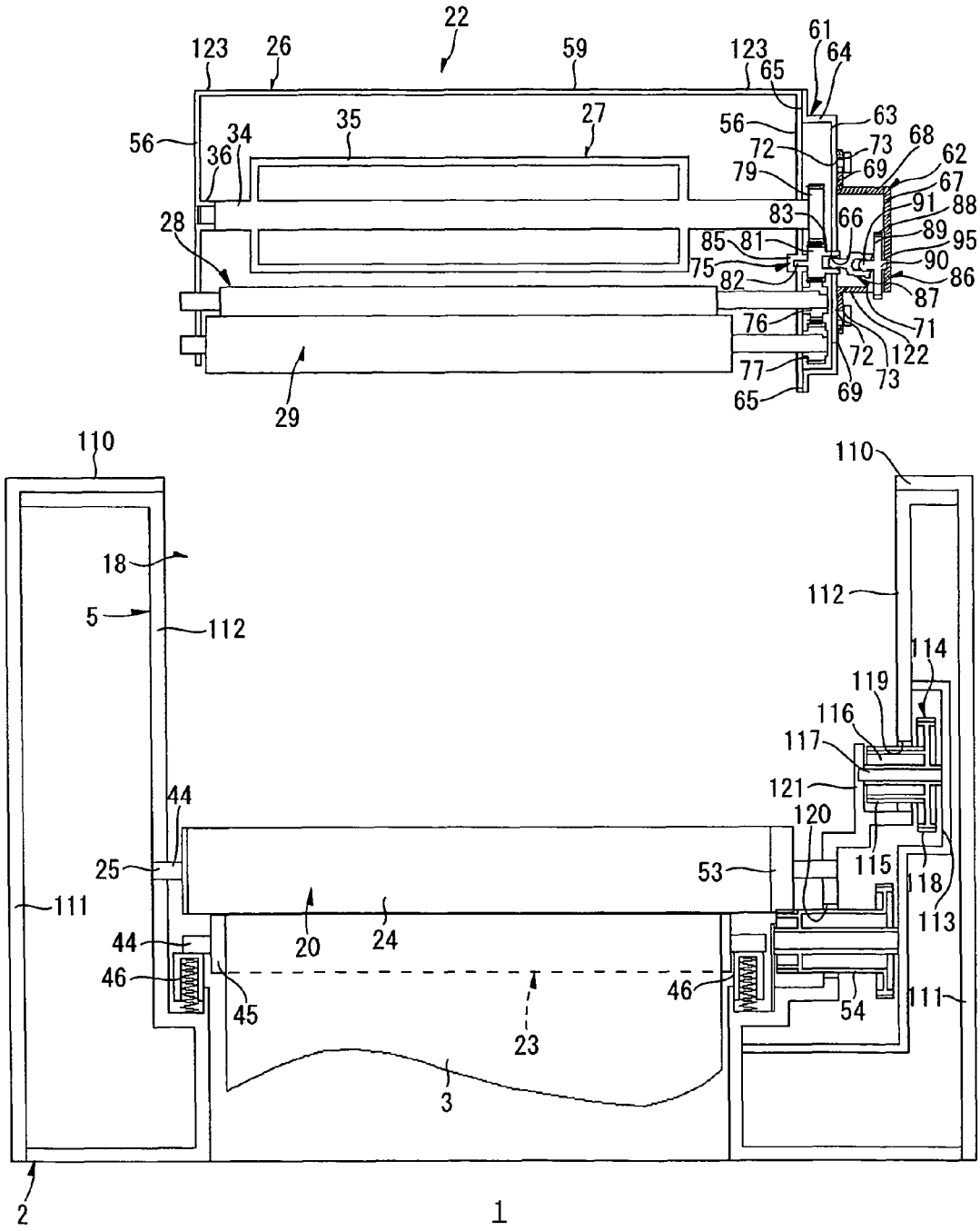
FIG. 2 is a front sectional view of the laser printer (with a developer cartridge detached).
Figure 4:
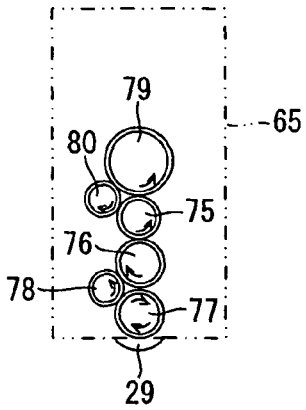
FIG. 4 is a layout drawing of gears in an inner gearbox as viewed from the right.
Figure 5:
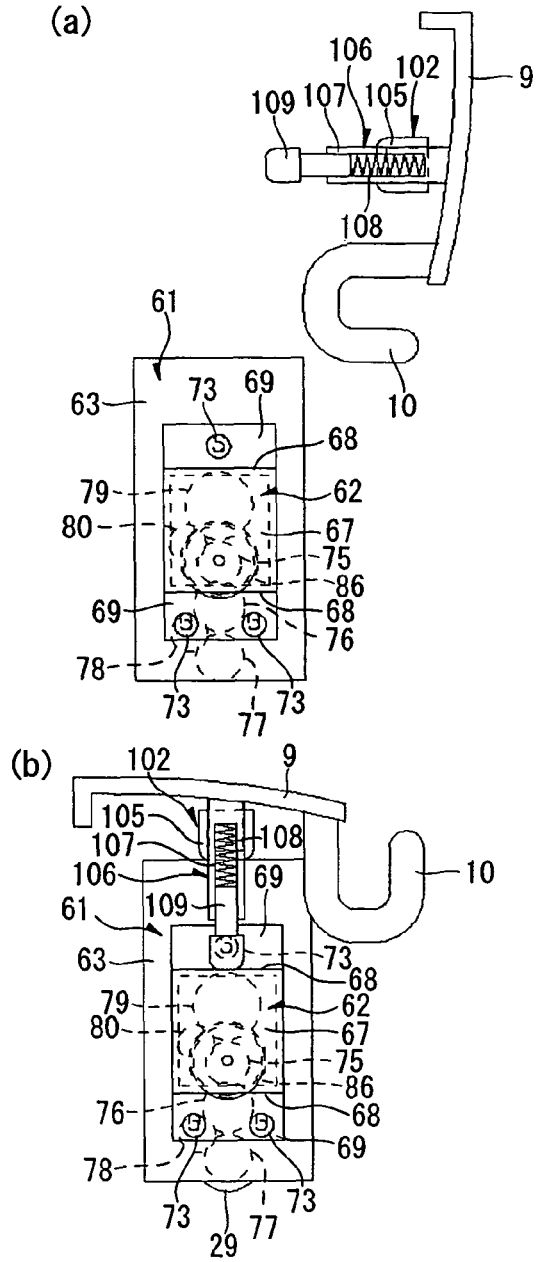
FIGS. 5(*a*) and 5(*b*) are side elevational views showing a main portion of the developer cartridge.

FIG. 2 is a front sectional view of a laser printer (with the developer cartridge detached), FIG. 3 is a front sectional view of the laser printer (with the developer cartridge attached), FIG. 4 is a layout drawing of gears in an inner gearbox, FIGS. 5(*a*) and 5(*b*) are side elevational views showing a main portion of the developer cartridge, wherein 5(*a*) shows the developer cartridge in a non-pressed position, and 5(*b*) shows the developer cartridge in a pressed position, and FIG. 6 is a perspective view showing a shaft coupling.

The top cover 9 is omitted in FIG. 2 for convenience of description. Furthermore, in an input gear 75 in FIG. 6, only a gear cylinder portion 83 is shown partially cut for convenience of description.

As shown in FIG. 2 and FIG. 3, the housing 26 of the developer cartridge 22 comprises an inner gearbox 61 and an outer gearbox 62 which is provided adjacent to the outside in widthwise direction (right side in the left and right direction) of the inner gearbox 61.

The inner gearbox 61 is provided on one of the sidewalls 56, and formed in a box-like shape in which that side of the sidewall 56 is left open.

More specifically, the inner gearbox 61 unitarily comprises an inner gear sidewall 63 disposed in opposed relation to the outside in widthwise direction of the sidewall 56 at an interval from the sidewall 56 and having a generally rectangular shape in side view, an inner gear round wall 64 that extends from a peripheral end portion of the inner gear sidewall 63 toward the sidewall 56 and abuts to the sidewall 56, and an inner flange wall 65 that abuts from the inner gear round wall 64 to the sidewall 56 and extends in up and down direction. The inner gearbox is formed generally in a shape of a hat in cross section.

Furthermore, a supporting hole 66 for supporting the gear cylinder portion 83 of the input gear 75 (later described) is perforated in the center portion of the inner gear sidewall 63.

The inner gearbox 61 is attached to the housing 26 relatively unmovably to the housing 26, by adhesively fixing the inner flange wall 65 to the sidewall 56 of the housing 26.

The outer gearbox 62 is provided on the inner gear sidewall 63 of the inner gearbox 61, and formed in a box-like shape in which the side of the inner gear sidewall 63 is open.

More specifically, the outer gearbox 62 unitarily comprises an outer gear sidewall 67 disposed in opposed relation to the outside in widthwise direction of the inner gear sidewall 63 at an interval from the inner gear sidewall 63 and having a generally rectangular shape in side view, an outer gear round wall 68 that extends from a peripheral end portion of the outer gear sidewall 67 towards the inner gear sidewall 63 and abuts to the inner gear sidewall 63, and an outer flange wall 69 that abuts from the outer gear round wall 68 to the inner gear sidewall 63 and extends in up and down direction. The outer gearbox is formed generally in a shape of a hat in cross section.

In the outer gear round wall 68, a lower side opening 71 for exposing a driven gear 86 (later described) is formed in the lower side right end portion, and the left side lower surface of the lower side opening 71 is an abutment portion 122 that can abut to an abutment wall 121 (later described).

In the outer flange wall 69, a single slot 72 that is long in the up and down direction is perforated in the upper side, and two slots 72 that are long in the up and down direction are perforated in the lower side, at an interval therebetween (c.f. FIG. 5).

The outer gearbox 62 is attached to the inner gearbox 61 relatively movably to the inner gearbox 61 in the up and down direction within the range corresponding to the width in the up and down direction of the slot 72, by inserting screws 73 to respective slots 72 of the outer flange wall 69 and then screwing each inserted screw 73 to the inner gear sidewall 63 (c.f. FIG. 5).

In the inner gearbox 61, as shown in FIG. 4, the input gear 75, the supply roller driving gear 76, the developer roller driving gear 77, and the lower side idle gear 78, the agitator driving gear 79 and the upper side idle gear 80 are provided.

The input gear 75 unitarily comprises a disk-shaped gear portion 81 in which gear teeth are formed on the outer peripheral surface thereof, a rotating shaft 82 provided on the left side of the gear portion 81, and a gear cylinder portion 83 provided on the right side of the gear portion 81 and receiving a shaft coupling 87 (later described).

In the gear cylinder portion 83, as shown in FIG. 6, tapered projecting strips 84 that are gradually narrowed from the right side to the left side are formed to oppose to one another on the inner peripheral surface.

Furthermore, in the input gear 75 as shown in FIG. 2 and FIG. 3, the rotating shaft 82 is rotatably supported on a bearing portion 85 provided on the sidewall 56 of the housing 26, while the gear cylinder portion 83 thereof is inserted through the supporting hole 66 of the inner gear sidewall 63 and rotatably supported. Thus, the input gear 75 is rotatably supported within the inner gearbox 61.

The supply roller driving gear 76 is unitarily provided with the supply roller shaft 38 at one shaft end portion of the supply roller shaft 38. The supply roller driving gear 76 is disposed below the input gear 75, and meshes with the gear portion 81 of the input gear 75.

The developer roller driving gear 77 is unitarily provided with the developing roller shaft 40 at one shaft end portion of the developing roller shaft 40. The developer roller driving gear 77 is disposed below the supply roller driving gear 76.

The lower side idle gear 78 is disposed in the front of the portion between the supply roller driving gear 76 and the developer roller driving gear 77, and rotatably supported on the sidewall 56 of the housing 26, as shown in FIG. 4. The lower side idle gear 78 meshes with the supply roller driving gear 76 and the developer roller driving gear 77.

The agitator driving gear 79 is unitarily provided with the agitator rotating shaft 34 at one shaft end portion of the agitator rotating shaft 34, as shown in FIG. 2 and FIG. 3. The agitator driving gear 79 is disposed above the input gear 75.

The upper side idle gear 80 is disposed in the front of the portion between the input gear 75 and the agitator driving gear 79 and rotatably supported on the sidewall 56 of the housing 26, as shown in FIG. 4. The upper side idle gear 80 meshes with the input gear 75 and the agitator driving gear 79.

In the outer gearbox 62, the driven gear 86 and the shaft coupling 87 are provided as shown in FIG. 2 and FIG. 3.

The driven gear 86 unitarily comprises a disk-shaped driven gear portion 89 which is disposed in parallel along the attaching/detaching direction of the developer cartridge 22 and in which driven gear teeth 88 are provided on the outer peripheral surface, a driven rotating shaft 90 provided on the right side of the driven gear portion 89, and a first joint portion 91 provided on the left side of the driven gear portion 89 and inserted into the shaft coupling 87.

The first joint portion 91 unitarily comprises a joint shaft 92 that protrudes from the shaft center of the driven gear portion 89 to the left side, a head portion 93 provided at the free end portion (left end portion) of the joint shaft 92, and shaft portions 94 that respectively protrude in a direction perpendicular to the axial direction of the joint shaft 92 from both sides of the head portion 93, as shown in FIG. 6.

In the driven gear 86, as shown FIG. 2 and FIG. 3, the driven rotating shaft 90 is rotatably supported on the bearing portion 95 provided on the outer gear sidewall 67 of the outer gearbox 62, while the first joint portion 91 is inserted into the shaft coupling 87 (described below), thereby rotatably supported within the outer gearbox 62.

Furthermore, the driven gear 86 is disposed so that a part of the lower side of the driven gear portion 89 exposes from the lower side opening 71 of the outer gearbox 62.

The shaft coupling 87 is disposed between the input gear 75 and the driven gear 86, and unitarily comprises a coupling cylinder portion 96 and a second joint portion 97 as shown in FIG. 6.

The coupling cylinder 96 has a closed-end cylindrical shape with a left sidewall, and swelled portions 98 that swell to the outside in the radial direction are provided on the outer round wall in an opposed relation with each other. Each swelled portion 98 is formed generally in a rectangular shape along the axial direction of the coupling cylinder 96.

The second joint portion 97 unitarily comprises a joint shaft 99 that protrudes from the shaft center of the left sidewall of the coupling cylinder 96 to the left side, a head portion 100 provided at the free end portion (left end portion) of the joint shaft 99, and shaft portions 101 that respectively protrude in a direction perpendicular to the axial direction of the joint shaft 99 and the opposing direction of the respective swelled portion 98 from both sides of the head portion 100.

In the shaft coupling 87, the head portion 93 of the first joint portion 91 of the driven gear 86 is accepted by the coupling cylinder 96, so that each shaft portion 94 is accepted by each swelled portion 98 in a state of being slidable in left and right direction and regulating rotation in the radial direction. Thus, the coupling cylinder 96 is swingably yet relatively unrotatably connected to the first joint portion 91 with each shaft portion 94 of the first joint portion 91 as the supporting point.

Furthermore, in the shaft coupling 87, the second joint portion 97 is inserted in the gear cylinder portion 83 of the input gear 75, and the head portion 100 is inserted into the portion between the projecting strips 84 in opposing direction thereof and held between the projecting strips 84 at the shaft center, while each shaft portion 101 is inserted between the projecting strips 84 in the round direction. Thus, the second joint portion 97 is swingably yet relatively unrotatably connected to the gear cylinder portion 83 with each shaft portion 101 of the second joint portion 97 as the supporting point.

As a result, the shaft coupling 87 connects the driven gear 86 and the input gear 75 so as the driven gear 86 and the input gear 75 unitarily rotates at the shaft centers of the driven gear 86 and the input gear 75. Furthermore, each of the shaft portions 101 of the second joint portion 97 is provided in a direction perpendicular to the opposing direction of each swelled portion 98. Therefore, even when the shaft center of the driven gear 86 and the shaft center of the input gear 75 move relatively so as to misalign in an anteroposterior direction and in up and down direction, the shaft coupling 87 conforms to the misalignment and allows the relative displacement, and maintains the connection.

3. Construction of Main Body Casing

In the top cover 9, the housing pressing member 102 for pressing the housing 26 of the developer cartridge 22, and a an outer gearbox pressing member 106 for pressing the outer gearbox 62 of the developer cartridge 22 are provided as shown in FIG. 3 and FIG. 5.

The housing pressing members 102 are provided on both sides in the widthwise direction on the lower surface of the top cover 9. Each housing pressing member 102 comprises a boss portion 103 that protrudes downward from the lower surface of the top cover 9, a spring 104 that is joined to the lower end portion of the boss portion 103, and a cylindrical pressing portion 105 that is joined to the lower end portion of the spring 104 so as to externally fit to the spring 104.

The outer gearbox pressing member 106 is provided on the lower surface of the top cover 9 at the end portion of one side in the widthwise direction (right side end portion in left and right direction) of the top cover 9 on the outside of the housing pressing member 102. The outer gearbox pressing member 106 comprises a cylinder portion 107 that protrudes downward from the lower surface of the top cover 9 longer than the boss portion 103, a spring 108 that is inserted in the cylinder portion 107, and a pressing protrusion 109 which is joined to the lower end portion of the spring 108 and whose lower end portion swells to have generally a mushroom shape.

Furthermore, the main body casing 2 comprises a pair of sidewalls 110 that are disposed in opposed relation to each other in widthwise direction, as shown in FIG. 2 and FIG. 3. Each sidewall 110 comprises a cover sidewall 111 that is disposed on the outside in widthwise direction, and a support sidewall 112 disposed on the inside in widthwise direction (left side in left and right direction).

A gear support wall 113 is provided on one sidewall 110, between the cover sidewall 111 and the support sidewall 112. Furthermore, a driving gear opening 119 and a drum gear opening 120 for inserting a driving gear 114 and the drum gear 54 are perforated respectively in the support sidewall 112. Furthermore, an abutment wall 121 that extends in up and down direction is provided on the support sidewall 112, so that the abutment wall 121 opposes to the driving gear opening 119 in widthwise direction.

In the main body casing 2, the driving gear 114 that can mesh with the driven gear 86 is provided on the gear support wall 113. The driving gear 114 is disposed so that when the developer cartridge 22 is mounted to the main body casing 2, the driving gear 114 is disposed in opposed relation to the space between the supply roller 28 and the developer roller 29 in widthwise direction.

The driving gear 114 unitarily comprises a disk-shaped first driving gear portion 116 which is disposed parallel to the attaching/detaching direction of the developer cartridge 22 and on which driving gear teeth 115 are formed on the outer peripheral surface thereof, a drive rotating shaft 117 that extends from the shaft center of the first driving gear portion 116 in widthwise direction, and a second driving gear portion 118 that is provided on the outside of the first driving gear portion 116 in widthwise direction and larger in diameter than the first driving gear portion 116.

In the driving gear 114, one shaft end portion of the drive rotating shaft 117 is rotatably supported on the gear support wall 113, and the other shaft end portion of the drive rotating shaft 117 is rotatably supported on the abutment wall 121. As a result, the driving gear 114 is rotatably supported on the sidewall 110 of the main body casing 2, so that the lower portion of the first driving gear portion 116 is covered by the gear support wall 113 between the gear support wall 113 and the abutment wall 121 while the upper portion of the first driving gear portion 116 is exposed in the main body casing 2, and the second driving gear portion 118 is covered between the gear support wall 113 and the cover sidewall 111

A driving force from a motor (not shown) is input to the second driving gear portion 118.

4. Attachment of Developer Cartridge to Main Body Casing

In order to attach the developer cartridge 22 to the main body casing 2, first, the arm member 10 is pivoted upward, the top cover 9 is set in the upright position, and the upper opening 8 is opened, as shown in FIG. 5(*a*), then the developer cartridge 22 is mounted inside the main body casing 2 downward from the upper opening 8, as shown in FIG. 2.

Then, after the developer cartridge 22 is mounted in the main body casing 2, the arm member 10 is pivoted downward, the top cover 9 is set in the lying position and the upper opening 8 is closed as shown in FIG. 5(*b*).

Thus, as shown in FIG. 3 and FIG. 5(*b*), the pressing protrusion 109 of the outer gearbox pressing member 106 of the top cover 9 presses downward the upper surface of the outside gear round wall 67 of the outer gear box 62 by the biasing force of the spring 108, and an abutment portion 122 of the lower surface of the outer gearbox 62 is abutted to the upper end surface of the abutment wall 121 of the main body casing 2. As a result, the outer gearbox 62 is positioned relatively unmovably to the main body casing 2, and the driven gear teeth 88 of the driven gear portion 89 of the driven gear 86 mesh with the driving gear teeth 115 of the first driving gear portion 116 of the driving gear 114 along the attaching/detaching direction of the developer cartridge 22.

At the same time, the pressing portion 105 of the housing pressing member 102 of the top cover 9 presses downward the pressed portion 123 of the upper surface of the top wall 59 of the casing 26 by the biasing force of the spring 104. Then, as described above, with respect to the outer gearbox 62 that is positioned relative to the main body casing 2, the housing 26 and the inner gearbox 61 together move downward within the range corresponding to the width in up and down direction of the slot 72 of the inner gearbox 61, and the developer roller 29 is pressed against the photosensitive drum 20.

When the housing 26 and the inner gearbox 61 together move downward with respect to the outer gearbox 62, the shaft center of the driven gear 86 and the shaft center of the input gear 75 misalign in the up and down direction. However, the shaft coupling 87 conforms to the misalignment and allows the relative displacement, and maintains the connection.

In an image forming operation, the driving force from a motor (not shown) provided in the main body casing 2 is input to the second driving gear portion 118 of the driving gear 114.

Then, the driving force is input from the first driving gear portion 116 that is simultaneously rotationally driven with the second driving gear portion 118 to the driven gear portion 89 of the driven gear 86 that meshes with the first driving gear portion 116.

The driving force input to the driven gear portion 89 is input from the first joint portion 91 that is simultaneously rotationally driven with the driven gear portion 89 to the gear cylinder 83 of the input gear 75 via the shaft coupling 87.

The driving force input to the input gear 75 is transmitted from the gear portion 81 of the input gear 75 to the supply roller driving gear 76, and is further transmitted from the supply roller driving gear 76 to the developer roller driving gear 77 via the lower side idle gear 78. Thus, the supply roller 28 and the developer roller 29 are rotationally driven.

Furthermore, the driving force input to the input gear 75 is transmitted from the gear portion 81 of the input gear 75 to the agitator driving gear 79 via the upper side idle gear 80, and thereby the agitator 27 is rotationally driven.

5. Operational Advantage of the Embodiment

As aforementioned, when the developer cartridge 22 is mounted in the main body casing 2, the driving force input from the driving gear 114 is received by the driven gear 86, and then transmitted from the driven gear 86 to the input gear 75 via the shaft coupling 87, and further transmitted from the input gear 75 to the developer roller driving gear 77 via the supply roller driving gear 76 and the lower side idle gear 78, thereby rotationally driving the developer roller 29.

Since the shaft coupling 87 allows the relative movement of the driven gear 86 and the input gear 75 and connects the driven gear 86 and the input gear 75, the developer cartridge 22 may allow a free movement of the input gear 75 relative to the driven gear 86. Therefore, even when the housing 26 and the inner gearbox 61 together move downward relative to the positioned outer gearbox 62 due to the housing 26 being pressed with the housing pressing member 102, and the shaft center of the driven gear 86 and the shaft center of the input gear 75 misalign with each other in up and down direction, the shaft coupling 87 conforms to the misalignment and allows the relative movement and maintains the connection. As a result, assured pressure of the developer roller 29 to the photosensitive drum 20 can be achieved.

In addition, since the shaft coupling 87 is provided to the developer cartridge 22, there is no need to provide such shaft coupling 87 nor a coupling member to the main body casing 2, thereby enabling to simplify the maintenance.

Furthermore, when the developer cartridge 22 is mounted in the main body casing 2, the driving gear 114 and the driven gear 86 are connected, and the driving force is input from the driving gear 114 to the driven gear 86. Furthermore, the driven gear 114 and the input gear 75 are connected via the shaft coupling 87, and the driving force is input from the driven gear 114 to the input gear 75. Hence, assured transmission of a driving force can be achieved with a simple construction.

More specifically, when the developer cartridge 22 is mounted in the main body casing 2, the driven gear teeth 88 provided on the outer peripheral surface of the driven gear 86 provided in the developer cartridge 22 meshes with the driving gear teeth 115 provided on the outer peripheral surface of the driving gear 114 provided in the main body casing 2, thereby connecting the driving gear 114 and the driven gear 86. Then the driving force input from the driving gear 114 provided in the main body casing 2 is transmitted to the driven gear 86, and whereby the agitator 27, the supply roller 28 and the developer roller 29 are rotationally driven.

The meshing or releasing of the driving gear 114 with the driven gear 86 subsequent to the attachment/detachment of the developer cartridge 22 can be easily and reliably achieved by the meshing or releasing of the driving gear teeth 115 of the driving gear 114 with the driven gear teeth 88 of a driven gear 86. As a result, failure is infrequent, and the maintenance is simplified.

Furthermore, when the developer cartridge 22 is mounted in the main body casing 2, the outer gearbox 62 is positioned relative to the main body casing 2, and the housing 26 and the inner gearbox 61 becomes together relatively movable to the outer gearbox 62. The driving gear 114 provided in the main body casing 2 is connected with the driven gear 86 provided in the positioned outer gearbox 62, and the driven gear 86 is connected via the shaft coupling 87 to the input gear 75 provided in the inner gearbox 61 that is relatively movable to the outer gearbox 62. Therefore, the driven gear 86 of the outer gearbox 62 can reliably receive the driving force from the driving gear 114 of the main body casing 2, while the free movements of the housing 26 and the inner gearbox 61 relative to the main body casing 2 can be ensured. As a result, assured pressing of the developer roller 29 against the photosensitive drum 20 can be achieved through the pressing of the housing 26 by the housing pressing member 102.

Furthermore, when the developer cartridge 22 is mounted in the main body casing 2, the pressing protrusion 109 of the outer gearbox pressing member 106 of the top cover 9 presses downward the upper surface of the outer gear round wall 67 of the outer gearbox 62 by the biasing force of the spring 108, and the abutment portion 122 of the lower surface of the outer gear round wall 67 is abutted to the upper end surface of the abutment wall 121 of the main body casing 2. Thus, the outer gearbox 62 is positioned relatively unmovably to the main body casing 2. As a result, assured mesh of the driven gear teeth 88 of the driven gear 86 with the driving gear teeth 115 of the driving gear 114 can be ensured, and the driving force from the driving gear 114 of the main body casing 2 can be reliably received by the driven gear 86.

Furthermore, when the developer cartridge 22 is mounted in the main body casing 2, the pressing portion 105 of the housing pressing member 102 of the top cover 9 presses downward the pressed portion 123 of the upper surface of the top wall 59 of the housing 26 by the biasing force of the spring 104, and the developer roller 29 is pressed against the photosensitive drum 20. Therefore, the developer roller 29 is reliably pressed against the photosensitive drum 20, and a high-precision development by the photosensitive drum 20 can be achieved.

Furthermore, in the developer cartridge 22, the driven gear 86 and the input gear 75 are connected via the shaft coupling 87 that is swingable in the anteroposterior direction and in the up and down direction, hence the input gear 75 can reliably move freely relative to the driven gear 86 with a simple construction.

Furthermore, when the developer cartridge 22 is mounted in the main body casing 2, the driven gear 86 meshes with the driving gear 114 along the mounting direction of the developer cartridge 22, hence the driving gear 114 and the driven gear 86 can easily and reliably be meshed, and the driving force can reliably be transmitted from the driving gear 114 to the driven gear 86.

Since the laser printer 1 comprises the aforementioned developer cartridge 22, assured transmission or interruption of the driving force can be achieved with a simple construction. As a result, failure is infrequent, and the maintenance is simplified.

In regard to the aforementioned embodiment, in the processing section 18, the photosensitive drum 20, the scorotron type charger 21 and the transfer roller 23 are provided in the main body casing 2. However, the photosensitive drum 20, the scorotron type charger 21 and the transfer roller 23 may be provided in a drum cartridge that is removably mountable in the main body casing 2 to removably mount the developer cartridge 22 to the drum cartridge.

In this case, an abutment wall that can abut to the abutment portion 122 of the outer gearbox 62 is provided in the drum cartridge, and when the developer cartridge 22 is mounted, the outer gearbox 62 is positioned relative to the drum cartridge and the main body casing 2 by abutting the abutment portion 122 with the abutment wall.

In an image forming operation, the driving force from the driving gear 114 provided in the main body casing 2 may be input to the driven gear 86 via the drum cartridge.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. A developer cartridge comprising:

a developer roller, a receiving unit configured to receive a driving force, wherein the receiving unit includes a first gear that is connected with a second gear inputting the driving force, a transmitting unit configured to transmit the driving force from the receiving unit to the developer roller, wherein the transmitting unit includes a third gear, a first unit having the first gear, a housing provided with the developer roller, a transferring unit configured to transfer the drive force from the receiving unit to the transmitting unit, the transferring unit being connected with both the receiving unit and the transmitting unit, wherein the third gear is connected to the first gear via the transferring unit a second unit having the developer roller and the third gear, and movable with respect to the first unit, wherein the transferring unit is disposed between the first gear and the third gear, an inner gearbox provided with the third gear and attached to the housing relatively unmovably to the housing, and an outer gearbox provided with the first gear and attached to the inner gearbox relatively movably to the inner gearbox, wherein a relative position of the receiving unit and the transmitting unit is movable while the transferring unit is connected to both the receiving unit and the transmitting unit.

2. A developer cartridge according to claim 1, wherein the first gear includes first gear teeth on a peripheral surface of the first gear, and the first gear teeth are configured to engage with second gear teeth provided on a peripheral surface of the second gear.

3. A developer cartridge according to claim 1, wherein the second unit is provided adjacent to the first unit.

4. A developer cartridge according to claim 1, wherein the first unit comprises an abutment portion for positioning the first unit by abutting an abutment member.

5. A developer cartridge according to claim 1, wherein the second unit comprises a pressed portion that is pressed in a direction to which the developer roller is pressed against a photosensitive member.

6. A developer cartridge according to claim 1, wherein the first gear includes a first rotating axis, the third gear includes a second rotating axis, and the transferring unit includes a shaft coupling that is disposed so as to connect the first rotating axis and the second rotating axis and that is configured to follow a misalignment between the first rotating axis and the second rotating axis.

7. A developer cartridge according to claim 6, wherein the first rotating axis is disposed in perpendicular to an attaching/detaching direction of the developer cartridge relative to an image forming apparatus.

8. An image forming apparatus comprising:

a body, a driving unit provided in the body, the driving unit including a second gear that is connected with a first gear and that inputs the driving force to the first gear, and a developer cartridge removably attachable to the body, wherein the developer cartridge includes a developer roller, a receiving unit configured to receive a driving force from the driving unit, the receiving unit including the first gear, a first unit having the first gear, a transmitting unit configured to transmit the driving force from the receiving unit to the developer roller, the transmitting unit including a third gear that is connected to the first gear via a transferring unit, a second unit having the developer roller and the third gear, wherein the second unit is movable with respect to the first unit, and the transferring unit configured to transfer the drive force from the receiving unit to the transmitting unit, wherein the transferring unit is disposed between the first gear and the third gear, wherein a relative position of the receiving unit and the transmitting unit is movable while the transferring unit transfers the drive force from the receiving unit to the transmitting unit.

9. An image forming apparatus according to claim 8, wherein the first gear includes first gear teeth on a peripheral surface of the first gear, and the first gear teeth are configured to engage with second gear teeth provided on a peripheral surface of the second gear.

10. An image forming apparatus according to claim 8, wherein the second unit is provided adjacent to the first unit.

11. An image forming apparatus according to claim 8, comprising an abutment member abutting the first unit for positioning the first unit with respect to the body.

12. An image forming apparatus according to claim 8, comprising a pressing member pressing the second unit in a direction to which the developer roller is pressed against a photosensitive member.

13. An image forming apparatus according to claim 8, wherein the first gear includes a first rotating axis, the third gear includes a second rotating axis, and the transferring unit includes a shaft coupling that is disposed so as to connect the first rotating axis and the second rotating axis and that is configured to follow a misalignment between the first rotating axis and the second rotating axis.

14. An image forming apparatus according to claim 13, wherein the first rotating axis is disposed in perpendicular to an attaching/detaching direction of the developer cartridge relative to the body.

* * * * *

UNITED STATES PATENT AND TRADEMARK OFFICE

CERTIFICATE OF CORRECTION

PATENT NO. : 7,817,938 B2
APPLICATION NO. : 11/603000
DATED : October 19, 2010
INVENTOR(S) : Hiroshi Igarashi It is certified that error appears in the above-identified patent and that said Letters Patent is hereby corrected as shown below:

On the cover page, Title section (54):

Please delete "Developer Cartridge and Image Forming Apparatus With Shaft Misalignment Accomodation" and insert -- Developer Cartridge and Image Forming Apparatus With Shaft Misalignment Accommodation --

In Column 1, Line 1:

Please delete "Developer Cartridge and Image Forming Apparatus With Shaft Misalignment Accomodation" and insert -- Developer Cartridge and Image Forming Apparatus With Shaft Misalignment Accommodation --

Signed and Sealed this
Twenty-third Day of August, 2011

David J. Kappos

David J. Kappos
*Director of the United States Patent and Trademark Office*